United States Patent [19]

Akama

[11] 4,229,288

[45] Oct. 21, 1980

[54] LINEAR MOTOR TYPE, NON-MAGNETIC METAL SEPARATING APPARATUS

[75] Inventor: Masaru Akama, Toyohashi, Japan

[73] Assignee: Shinko Electric Co., Ltd., Tokyo, Japan

[21] Appl. No.: 892

[22] Filed: Jan. 4, 1979

[30] Foreign Application Priority Data

Mar. 16, 1978 [JP] Japan ..... 53-30269

[51] Int. Cl.[3] ..... B03C 1/08

[52] U.S. Cl. ..... 209/212; 209/225; 209/227; 209/478; 209/480

[58] Field of Search ..... 209/212–214, 209/227, 223 R, 40, 478, 467, 469, 472, 480, 225, 226

[56] References Cited

U.S. PATENT DOCUMENTS

| | | | |
|---|---|---|---|
| 1,463,713 | 7/1923 | Mordey | 209/227 |
| 2,154,180 | 4/1939 | O'Toole et al. | 209/467 |
| 3,033,369 | 5/1962 | Kragle | 209/223 R |
| 3,852,168 | 12/1974 | Oetiker | 209/467 X |
| 4,137,156 | 1/1979 | Morey et al. | 209/212 |

FOREIGN PATENT DOCUMENTS

| | | | |
|---|---|---|---|
| 50-127265 | 10/1975 | Japan . | |
| 423523 | 2/1935 | United Kingdom | 209/223 R |

*Primary Examiner*—Ralph J. Hill

*Attorney, Agent, or Firm*—Lane, Aitken, Ziems, Kice and Kananen

[57] ABSTRACT

Apparatus for separating non-magnetic metals to permit recovery, for example, of aluminium and other non-magnetic metals mixed with materials having other compositions. The mix of materials are vibrationally conveyed in a first direction by a vibration feeder and a deflecting force in a second perpendicular direction is exerted on the non-magnetic metals by moving magnetic fields produced by a plurality of linear motors. The apparatus includes means for controlling the longitudinal tilt and the transverse inclination to optimize the separations achieved with different mixes of materials.

10 Claims, 3 Drawing Figures

LINEAR MOTOR TYPE, NON-MAGNETIC METAL SEPARATING APPARATUS

BACKGROUND OF THE INVENTION

The present invention relates to separating apparatus for recovering useful non-magnetic metals such as aluminium and the like from solid refuse. The apparatus utilizes a plurality of linear motors cooperatively with a vibration feeder.

The efficiency of separation achieved by apparatus for separating and recovering non-magnetic metals such as aluminium, copper and the like (hereinafter referred to as non-magnetic metals) from organic and inorganic non-metallic materials by vibratory conveyance of the mix of materials under deflecting forces exerted by moving magnetic fields produced by linear motor on the non-magnetic metallic materials is of great practical interest. Magnetic metals are readily separated with high efficiency using conventional magnet apparatus, but satisfactory separation yields are realized for non-magnetic metals only if apparatus having high efficiencies are used.

When the non-magnetic metals are mixed loosely or discretely with non-metallic substances, deflection forces produced by linear motors can be effectively used to achieve separation. Often the substances to be separated are first coarsely ground or pelletized to facilitate separation. When the non-magnetic metals are attached to or encased by relatively large amounts of non-metallic materials, separation efficiencies suffer, and to the extent separation occurs, the purity of the materials collected in the non-magnetic metal collector is less than desirable. Generally it is desirable to loosen, grind, or pelletize the materials to be separated in order to maximize the separation efficiencies and the purities of the separated metals.

SUMMARY OF THE INVENTION

It is therefore an object of the present invention to provide a high efficiency apparatus for separating non-magnetic metals of the type including a plurality of linear motors associated with a plurality of troughs arranged in successive steps as part of a vibratory feeder.

The present invention is described more fully with reference to the accompanying drawings.

DETAILED DESCRIPTION OF THE PREFERRED EMBODIMENT

Figure 1:
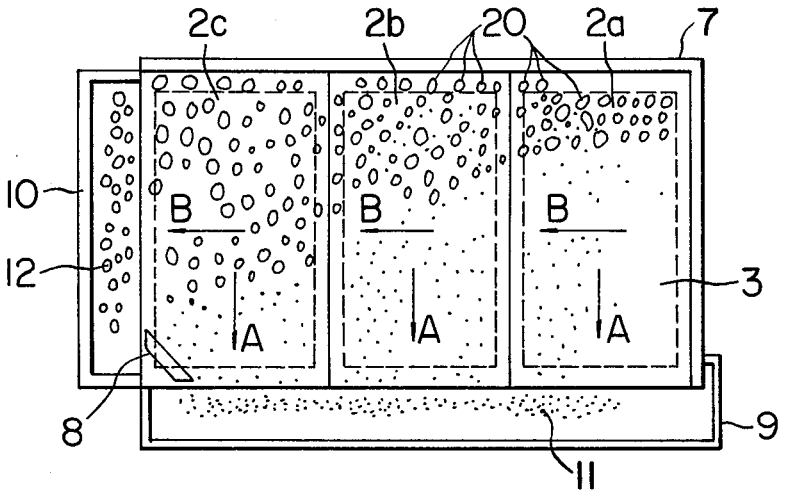
FIG. 1 is a plan view of the apparatus according to the present invention.
Figure 2:
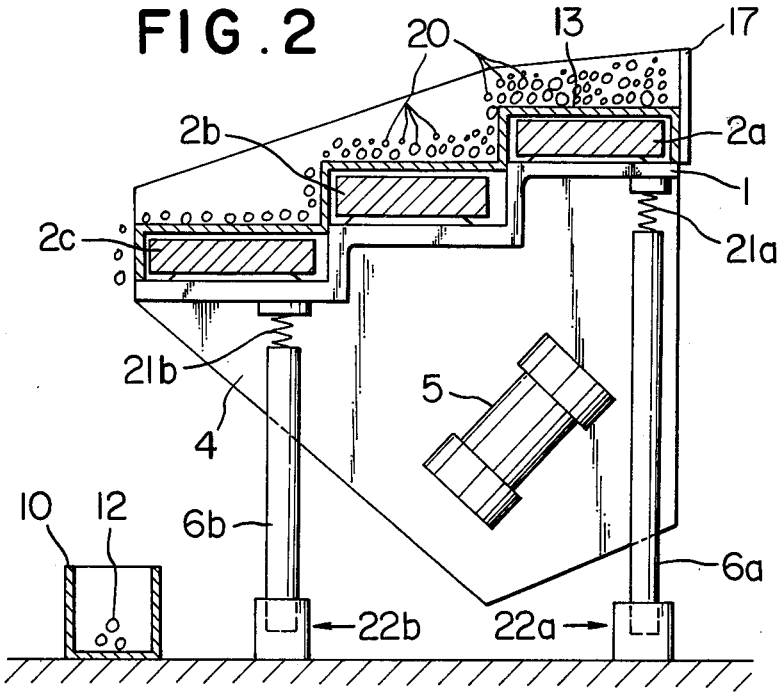
FIG. 2 is a partially-sectional, side view of the apparatus of FIG. 1.
Figure 3:
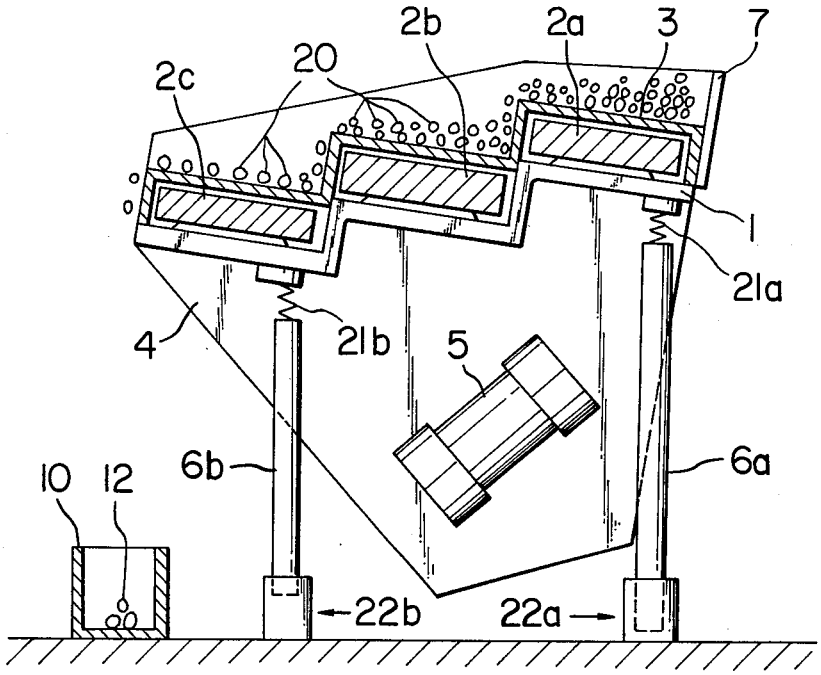
FIG. 3 is a view similar to that of FIG. 2 except the side view of the troughs are tilted to form a higher separation gradient.

Referring now to FIGS. 1 to 3, a vibrating deck 1 of a vibration feeder 4 is constructed in the form of "stair steps" consisting of successive steps as shown in FIGS. 2 and 3. A plurality of linear motors *2a*, *2b* and *2c* are arranged one each on each of the steps of the vibrating deck 1. The direction of the deflecting forces produced by the moving magnetic fields generated by the respective linear motors *2a*, *2b*, *2c* are indicated by the arrows "A" in FIG. 1. Although the disclosed embodiment includes three linear motors, the number of linear motors preferably is selected after due consideration of the type and quantity of the materials to be separated and capacities of the linear motors.

A covering surface 3 is constructed stair-like in a shape similar to the vibrating deck 1 and is disposed so as to cover the upper surfaces of the linear motors *2a*, *2b*, and *2c*. This covering surface 3 can be viewed as forming a plurality of troughs for the material 20 to be separated and preferably is constructed of a rigid non-magnetic material such as stainless steel, reinforced plastic or the like.

The vibration feeder 4 includes a vibration motor 5. The feeder 4 in combination with the motor 5 imparts a vibratory motion to the vibrating deck 1 in the direction of for example 45° to the bottom planes thereof so as to permit the mechanical vibratory conveying force to effectively be applied in the direction of the arrows "B". The vibration motor 5 could be replaced, for example, by another motor (not shown) including an electromagnetic iron core and springs.

The reference numerals *6a* and *6b* designate two (shown in one side view) of the four legs supporting the vibration feeder 4. The other two legs (not shown) are arranged, when viewed from the other side (not shown) in symmetrical positions relative to the center of the conveyance planes. Each of the four legs are required to be provided with an elastic member, such as springs *21a*, *21b*, etc. or the like, for absorbing vibration. The elastic members are preferably integrally mounted thereon, and may be fitted with mechanisms *22a*, *22b*, etc. for adjusting the height at which the various corners of the trough or cover 3 is supported with predetermined tilt and inclination angles. With this arrangement the conveyance planes of the trough 3 can be tilted and/or inclined at predetermined angles, for example, to provide rising or falling gradients to the vibratory direction of conveyance by the appropriate adjustment of the mechanisms *22a*, *22b*, etc. associated with the legs *6a*, *6b*, etc.

A dumping-up plate or wall 7 is attached to the cover or trough 3 on two adjoining sides thereof and prevents the feed material 20 to be separated from falling or being shaken off of the trough on those sides. Similarly, a dumping-up plate member 8 is provided at one end-corner of the lowest step of the trough or cover 3, and preferably is provided at the outside corner of the step at the end having a higher elevation to facilitate separation. A non-magnetic metal collecting receptacle 9 is disposed underneath the trough or cover 3 on the downstream side in the advancing direction of the moving magnetic field "A" to catch and collect non-magnetic metallic material 11 which drops off of that side of the trough or cover 3. Similarly, a non-metallic substance collecting receptacle 10 is disposed underneath the trough or cover 3 on the downstream side in the vibratory direction of conveyance "B" to catch and collect non-metallic material 12 which drops off of that side of the trough 3.

The operation of the apparatus according to the present invention will now be described. If ferromagnetic substances such as iron and the like are contained in the raw feed material, such substances will be attracted to and tend to prevent effective operation of the apparatus. For this reason, the raw feed material is preferably subjected to an initial separation step (not shown) using conventional magnet apparatus (not shown) to remove iron and other ferromagnetic substances. Similarly, electric wires and similar objects having a tendency to "coil" or to be difficult to separate are perferably eliminated from the feed material 20 by pre-removal or grinding or pelletizing of the raw feed material. As mentioned, the feed material 20 is preferably ground and pelletized by a mechanical means (not shown). The pretreated feed material 20 is then carried as a thin layer on a belt conveyer (not shown) and dropped onto the end corner portion of the trough 3 in the corner defined by the junction of the two adjoining sides to which the plate 7 is attached. A vibratory motion is imparted to the trough 3, tending to cause conveyance of the feed material 20 in the direction of the arrows "B". At the same time, the non-magnetic metallic portions of the feed material 20 on the trough 3 are subjected to deflecting forces in the direction indicated by the arrows "A" due to the moving magnetic fields of the linear motors *2a, 2b,* and *2c* disposed under the trough 3. As a result, the non-magnetic metallic portions of the feed material tend to travel to the edge of the apparatus and fall off into the metal collecting receptacle 9. The non-metallic substance portions, however, are not responsive to the moving magnetic field and tend to move in the vibratory direction of conveyance without deflection and fall off the edge of the apparatus into the non-metallic substance collecting receptacle 10.

The superior separation efficiencies achieved by apparatus according to the present invention are believed to be due, in part, to the feed material particles 20 experiencing turnover, collision against each other, and impulses when "dropped" during transit between successive steps of the stair-like trough 3. The adjustment mechanisms *22a, 22b,* etc. permitting independent adjustment of the heights at which the various corners of the trough 3 are separated by the legs *6a, 6b,* etc. allows control of the speed of movement of the feed material 20 on the trough 3. When the trough 3 is tilted, for example, to present a rising gradient to the vibratory direction of conveyance "B" as shown in FIG. 3, the speed of vibratory conveyance slows down and, accordingly, the time during which the material 20 is subjected to separation treatment by perpendicular deflecting forces from the linear motors *2a, 2b, 2c* increased. As a result, improved separation efficiencies can be achived. On the other hand, when relatively easily separable feed material 20 is supplied, improved throughput can be achieved by tilting the trough 3 to present a falling gradient so that the vibratory conveyance of the material occurs more quickly. Furthemore, when the weight of non-magnetic metal is heavy, it is advantageous to tilt the trough to the direction indicated by the arrows "A" so as to promote the deflecting force of the moving magnetic field produced by linear motors. To the contrary, if the weight of non-magnetic metal is light, it is desired to slightly tilt the trough to opposite direction to that indicated by arrows "A" so as to prevent non-magnetic metal from falling off vigorously over the trough by the moving magnetic field, and then dropping outside the receptacle 9. In the latter case, the dumping-up plate 7 serves to prevent materials to be fallen before separation. On the other hand, the dumping-up plate 8 effectively serves to achieve a final separation by linear motors at one end corner of the lowest step of the trough. As described above, the trough may be selectively tilted at a rising or lowering gradient either to the vibratory direction of conveyance or the perpendicular direction to the vibratory direction of conveyance, or in combination with both the same and perpendicular to the vibratory direction of conveyance. (For instance, the trough is tilted simultaneously at a rising gradient and inclined to the direction indicated by arrows "A".) The preferred degree of tilt and/or inclination for the trough should be set at attain maximum efficiency and depends upon the type and quantity of feed material, the capacities of the linear motors and the characteristics of vibration feeder.

Accordingly, it is seen that the invention achieves its various objects, and that various modifications and variations will be apparent to those skilled in the art without departing from the scope of the invention as defined in the appended claims.

What is claimed is:

1. A linear motor-type, non-magnetic metal separating apparatus comprising:

a vibration feeder provided with a vibrating deck and means for causing vibration and defining a vibrating direction of conveyance;

at least two linear motors disposed on the vibrating deck of said vibration feeder so that the advancing directions of the forces provided to non-magnetic metals to be separated by the moving magnetic fields of said linear motors are approximately parallel to one another and perpendicular to the vibratory direction of the conveyance; and a trough disposed as a cover for said linear motors and adapted to be vibrated by said vibration feeder from the underside thereof, said trough defining a series of steps.

2. Apparatus according to claim 1 further comprising adjustable means for supporting said trough in elevation with predetermined tilt and inclination.

3. Apparatus according to claim 2 wherein said adjustable means for supporting said trough is adjusted to tilt said trough at a rising gradient to the vibratory direction of conveyance.

4. Apparatus according to claim 2 wherein said adjustable means for supporting said trough is adjusted to tilt said trough at a lowering gradient to the vibratory direction of conveyance.

5. Apparatus according to claim 3 or 4 wherein said means for supporting said trough in elevation are also adjusted to tilt the trough at a rising gradient to the moving direction of magnetic field produced by said linear motors.

6. Apparatus according to claim 3 or 4 wherein said means for supporting said trough in elevation are also adjusted to tilt the trough at a lowering gradient to the moving direction of magnetic field produced by said linear motors.

7. Apparatus according to claim 1 wherein said means for supporting said trough in elevation are adjusted to tilt the trough at a rising gradient to the moving direction of magnetic field produced by said linear motors.

8. Apparatus according to claim 1 wherein said means for supporting said trough in elevation are adjusted to tilt the trough at a lowering gradient to the moving direction of magnetic field produced by said linear motors.

9. Apparatus according to claim 1 further comprising a dumping-up plate member provided at one end-corner of the lowest step of said trough where both directions of the deflecting force of moving magnetic field from said linear motors and of the vibratory direction of conveyance are crossed.

10. Apparatus according to claim 1 further comprising a dumping-up plate member attached to said trough of the side thereof opposing to the direction of moving magnetic field produced by said linear motors.

* * * * *